United States Patent [19]

Focke

[11] 4,424,658

[45] Jan. 10, 1984

[54] METHOD AND APPARATUS FOR THE PRODUCTION OF A DOUBLE PACKAGE

[75] Inventor: Heinz Focke, Verden, Fed. Rep. of Germany

[73] Assignee: Focke & Co., Verden, Fed. Rep. of Germany

[21] Appl. No.: 308,877

[22] Filed: Oct. 5, 1981

Related U.S. Application Data

[63] Continuation of Ser. No. 24,621, Jan. 16, 1979, abandoned.

[30] Foreign Application Priority Data

Aug. 18, 1981 [DE] Fed. Rep. of Germany ..... 2737223

[51] Int. Cl.[3] ..... B65B 11/08

[52] U.S. Cl. ..... 53/398; 53/443; 53/462; 53/466; 53/158

[58] Field of Search ..... 53/398, 462, 466, 98, 53/157, 158, 202, 207, 209, 218, 538, 443, 475, 538, 543, 252; 493/92, 93

[56] References Cited

U.S. PATENT DOCUMENTS

| | | | |
|---|---|---|---|
| 1,926,493 | 9/1933 | Molins | 53/158 |
| 2,066,449 | 1/1937 | Barre | 53/218 |
| 2,578,912 | 12/1951 | Waters . | |
| 2,701,938 | 2/1955 | Murray | 53/48 |
| 2,709,399 | 5/1955 | Smith | 53/157 X |
| 3,107,465 | 10/1963 | Cote | 53/48 X |
| 3,234,706 | 2/1966 | Arneson | 53/48 |
| 3,327,452 | 6/1967 | Cranston | 53/218 |
| 3,416,653 | 12/1968 | Farquhar . | |
| 3,473,295 | 10/1969 | Nigrelli | 53/157 X |
| 3,504,478 | 4/1970 | Dieter | 53/209 |
| 3,884,013 | 5/1975 | Solomon | 53/158 X |
| 3,978,773 | 9/1976 | Pinto | 493/93 X |
| 4,084,393 | 4/1978 | Focke . | |

FOREIGN PATENT DOCUMENTS

| | | |
|---|---|---|
| 2135486 | 12/1972 | France . |

*Primary Examiner*—John Sipos

*Attorney, Agent, or Firm*—Sughrue, Mion, Zinn, Macpeak & Seas

[57] ABSTRACT

Double packages with two trays which are formed from a common, one-piece blank and are connected in the area of central partitions (center panels), are manufactured such that the trays, which in the original position as a flat blank have a greater distance from each other, are pushed together while raising the connected center panels in the shape of a V. Subsequent to this are further folding steps for side and outer panels. This manufacturing process, including filling and folding can take place in stages while standing still in individual stations, or alternatively, in a continuous process.

3 Claims, 19 Drawing Figures

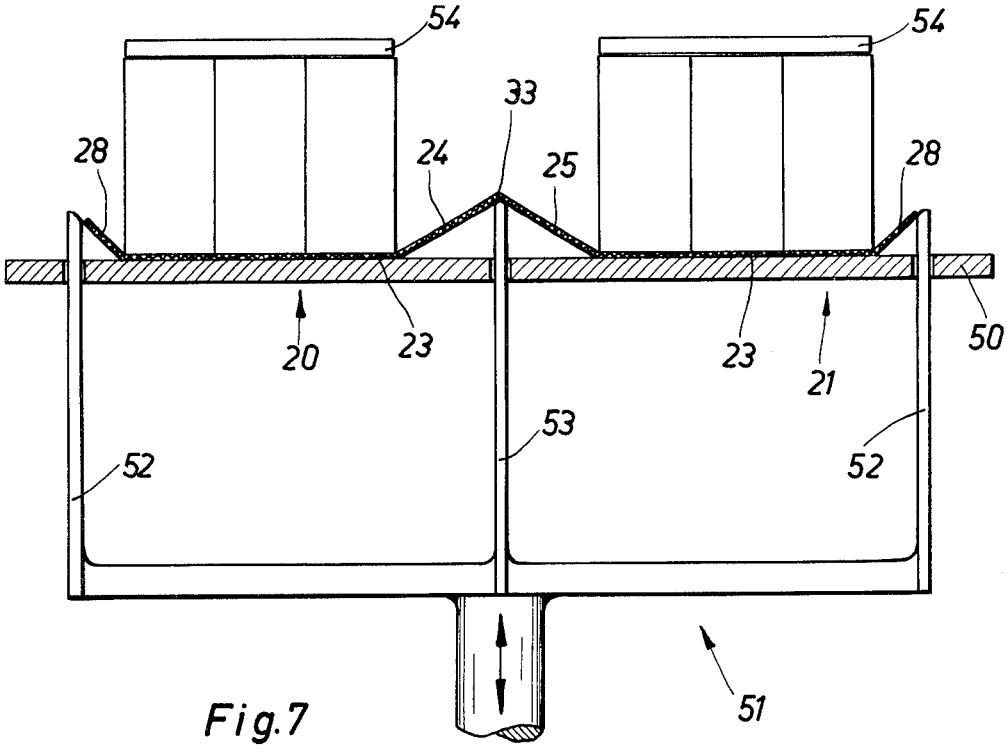
Fig.7
Fig. 8
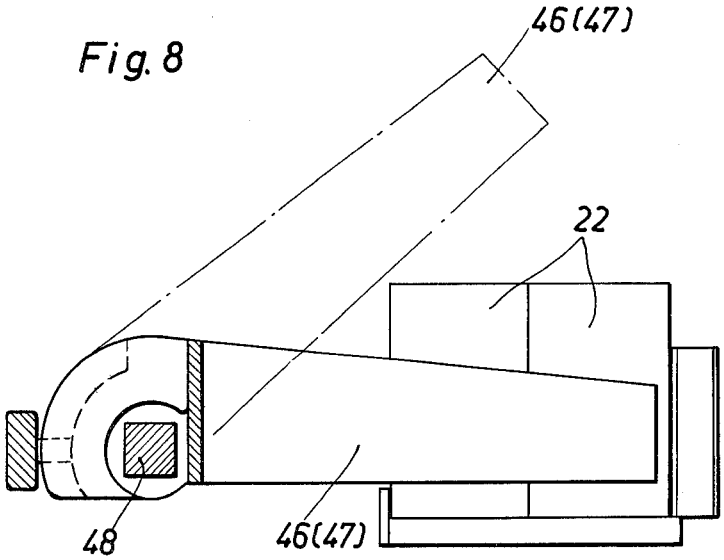

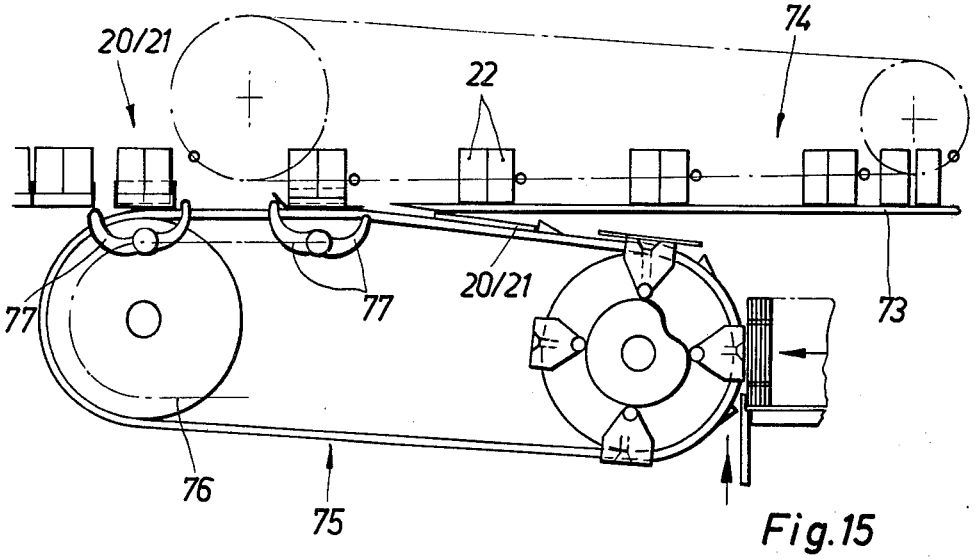
Fig.15
Fig. 16
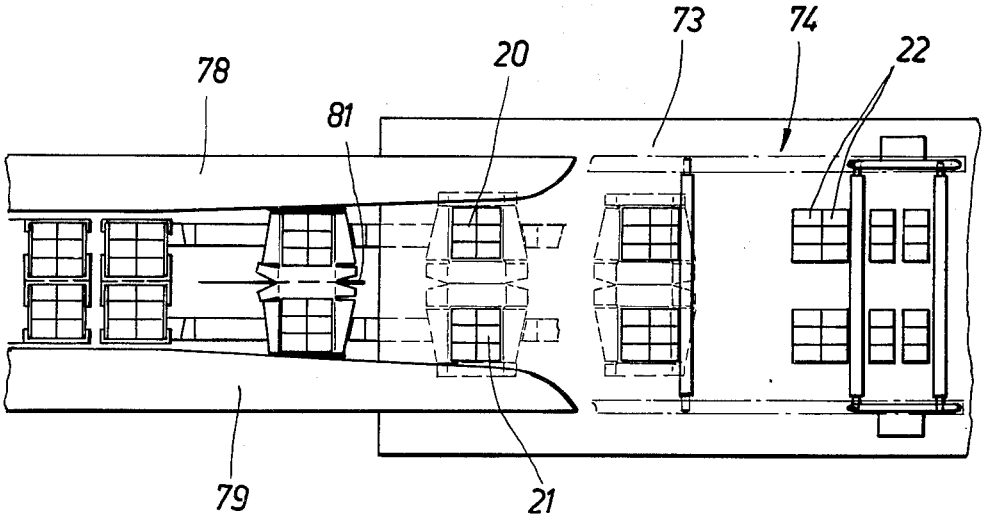

METHOD AND APPARATUS FOR THE PRODUCTION OF A DOUBLE PACKAGE

This is a continuation of application Ser. No. 024,621 filed Jan. 16, 1979.

BACKGROUND OF THE INVENTION

The invention relates to methods and apparatuses for the production of a package having two upwardly open individual packages (so-called trays) arranged next to each other and formed out of a one-piece blank, which are connected with each other in the area of two upright partitions (center panels) which face each other.

For technical production reasons and also for reasons of selling or distributing systems, double packages are desired which are connected with each other at least during production and transportation and therefore consist of a one-piece blank. The accordingly adjacent partitions or center panels of the individual packages are connected by means of a common, upper folding edge. The two packages can be separated from each other in this area. The primary concern of the invention is the production of the double package, including filling, with structural forming of the package or the blank for the production thereof, which is adapted to the production process.

SUMMARY OF THE INVENTION

The basic object of the invention is to put forward a method and apparatus by means of which double packages of the above-defined type can be efficiently manufactured at a high rate.

The method according to the invention of attaining this object is characterized in that the center panel of the package is brought into its upright position while forming a V by pushing the individual packages or trays together until they abut each other. According to a further feature of the invention the package contents, especially two groups of individual objects, are first transferred onto the spread blank, and the folding of the center panel then takes place as the package contents are pushed together.

The production of the package in this sense and with additional folding of the side edges and outer edges can, according to the invention, take place in steps, i.e. in individual stations, or continuously during the transport of the blanks with the package contents.

Further characteristics of the invention concern special method steps as well as structure and method of operation of devices for the step-wise or continuous production of these types of packages.

An exemplary embodiment of the package, a method of production thereof and apparatus therefor are described below in greater detail.

BRIEF DESCRIPTION OF THE DRAWINGS

FIG. 7 shows a simplified cross section through the apparatus according to FIG. 4, with enlarged scale, FIG. 8 shows a detail of the apparatus according to FIG. 4 in the area of the station according to FIG. 5 in side view, i.e. in cross section, also in enlarged scale, FIG. 15 shows an apparatus for the continuous production in the meaning of FIGS. 11 through 14 in schematic side view, and FIG. 16 shows a simplified plan view of FIG. 15.

DETAILED DESCRIPTION OF THE INVENTION

Figure 1:
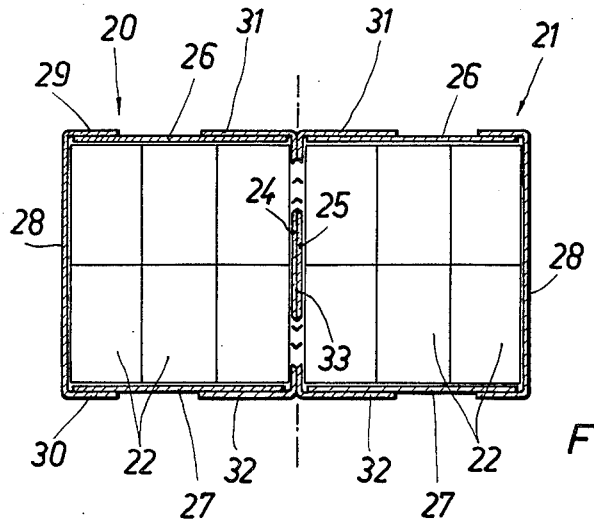
FIG. 1 shows a package of the present type in schematic plan view.

The package addressed here consists of two individual packages, specifically, so-called trays 20 and 21. The trays are separably connected with each other and form a package unit at least until separation. Each tray 20, 21 receives a separate package content, in the present case a group of individual packages 22. These have, in the present case, a rectangular shape and are arranged in such a manner that they completely cover a floor wall 23 of the trays 20, 21 if, as in the present case said floor wall has an approximately rectangular shape.

The package contents are surrounded on the trays 20, 21 by side partitions which only extend over a portion of the height of the individual packages 22. These partitions are, respectively, a center panel 24, 25, side panels 26 and 27 and an outer panel 28 which lies opposite the center panel 24 or 25. The center panel 24, 25 on one side and the outer panel 28 on the other side are respectively connected with the side panels 26, 27 in the adjacent areas by corner flaps 29, 30, 31 and 32 and with the previously mentioned side panels 26, 27, especially by gluing, thermal welding or the like.

Figure 2:
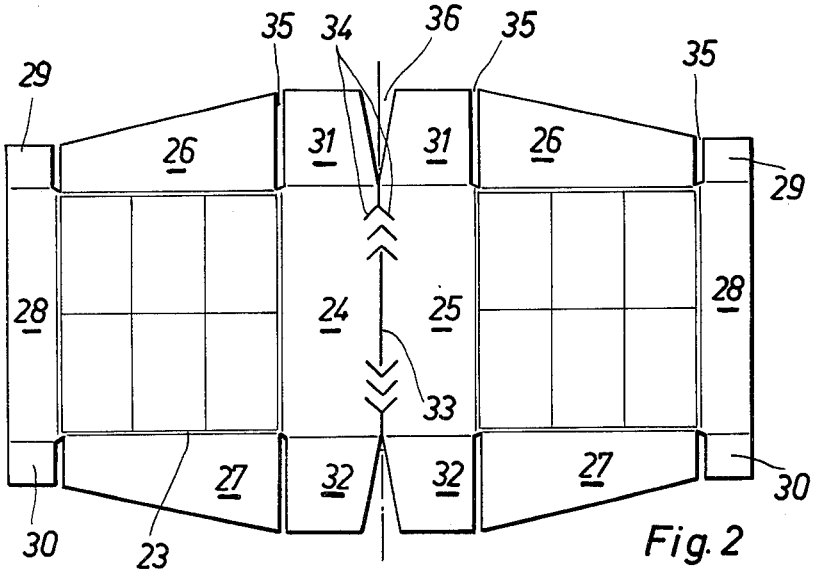
FIG. 2 shows a spread-out blank with package contents for a package according to FIG. 1, also in plan view.
Figure 3:
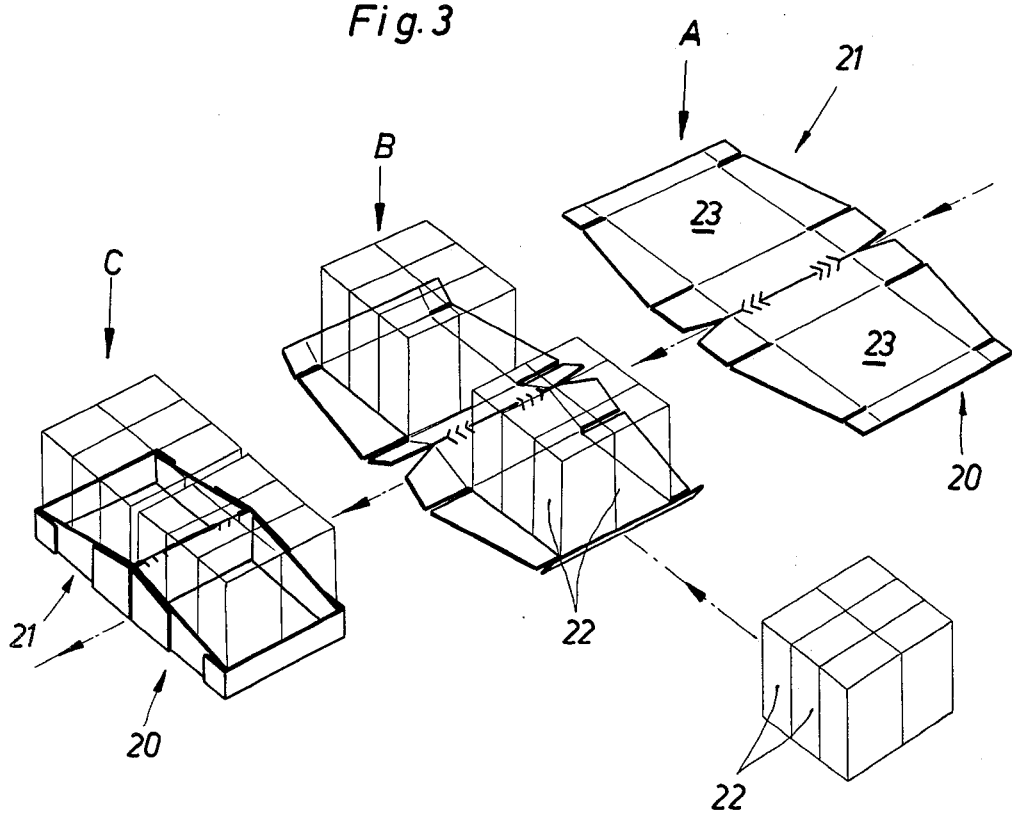
FIG. 3 shows three stations during the filling and manufacture of a package according to FIG. 1 in perspective illustration.
Figure 4:
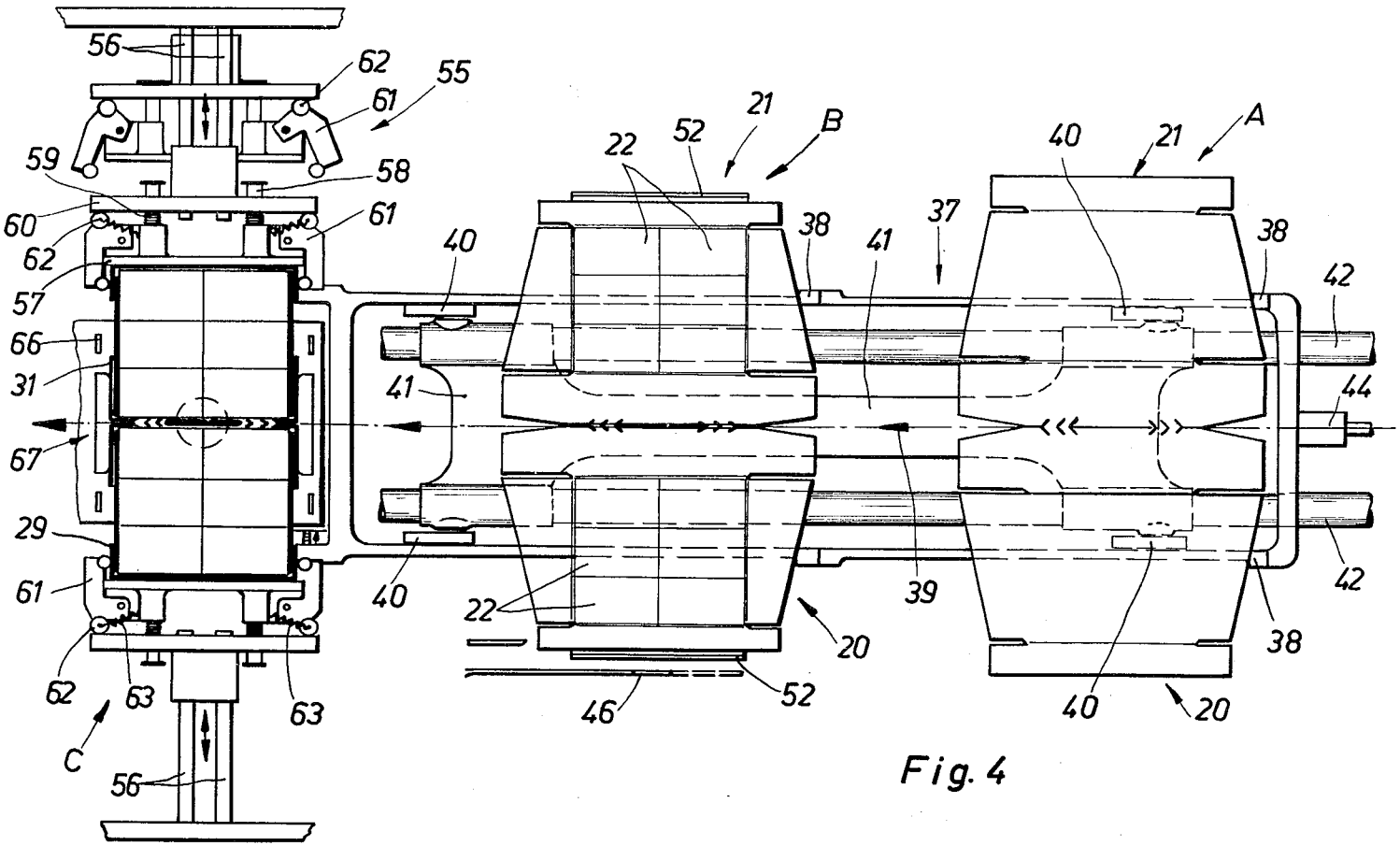
FIG. 4 shows a portion of an apparatus for step-wise production and filling of a package according to FIG. 1 in simplified plan view.
Figure 5:
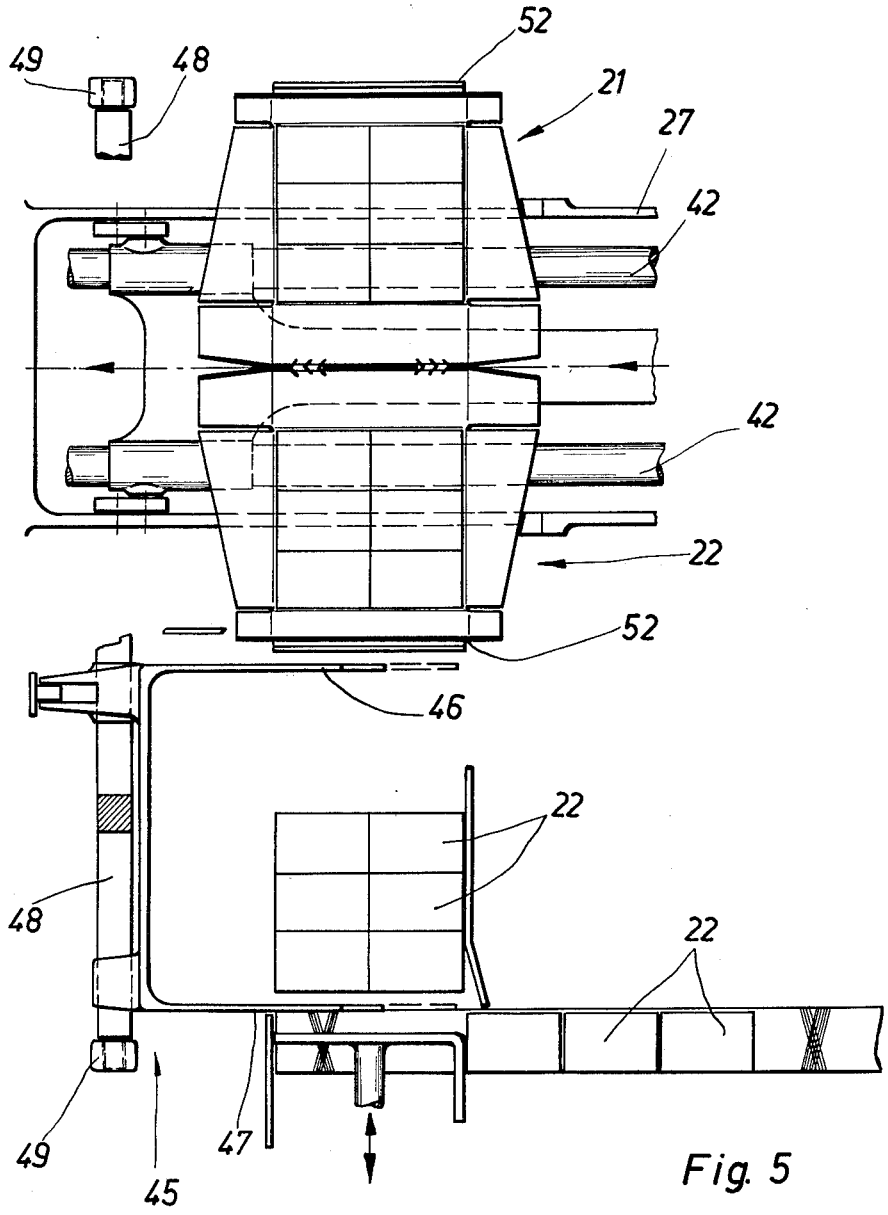
FIG. 5 shows a detail, namely a station of the apparatus according to FIG. 4, also in plan view.

The one-piece blank according to FIG. 2 is formed to conform to this construction of the double package. The center panels 24 and 25 are defined from each other by a lateral folding edge 33. This folding edge 33 is provided with special cut-outs 34, by means of which a possible separation of the package in the area of the folding edge 33 is facilitated.

Blank areas for the formation of the corner flaps 31, 32 are connected to the center panels 24, 25. At the sides, side panels 26 and 27 are connected with the floor wall 23. The outside corner flaps 29 and 30, in turn, are connected with the outer panels 28. Separating cuts 35 or 36 are placed between the corner flaps 29 . . . 32 on one side and the side panels 26, 27.

The production of the thus-described package including filling can take place in continuous or step-wise motion.

FIGS. 3 through 10 show details of the production of the package in step-wise operation. The blanks are conveyed for this purpose in stages along a straight path, thereby passing through three stations. In a first station A the spread-out blanks are transferred onto a conveyor, in the present case onto a back and forth moving transport frame 37. The blanks are thereby arranged in such a manner that the trays 20, 21 lie next to each other with regard to the direction of transport.

In a succeeding station B a number of operational steps are performed. First the package contents approaches laterally to the direction of transport, i.e. in the longitudinal direction of the blanks. The first-delivered group of individual packages is then transferred onto the first tray 20 and in a succeeding motion cycle onto the tray 21. In this second transport cycle for the group of individual packages 22 the second group is simultaneously brought forward, so that both groups are simultaneously placed onto the associated trays 20, 21.

In station B a further preliminary folding of the blank is performed. This concerns on one side the folding of the center panels 24 and 25 into a flat V-shaped intermediate folded position according to FIG. 7. At the same time the outer panels 28 are also moved into an angular position. At the same time the trays 20, 21 and with them the groups of individual packages 22 are brought toward each other.

In station C the package folding is then completed, in that the center panels 24, 25 are folded until they are brought into direct contact with each other as the trays 20 and 21 are brought together. Furthermore, the side panels 26 and 27 extending forward and backward in the direction of transport are erected until they contact the package contents. Finally the outer panels 28, too, are pivoted into their erect final position and the corner flaps 29 . . . 32 are bent by 90°.

The blanks are laid onto the transport frame 37 across the direction of transport in the station A. This transport frame 37 is equipped with two pairs of carriers 38 arranged at distances from each other, each of which contacts the back side of a blank. The transport frame 37 is driven back and forth in such a manner that during a stroke movement in the direction of the arrow 39 the blanks are transported from one station into the following one. The return movement of the transport frame 37 into the original position takes place in a plane beneath the delivery plane of the blanks.

Figure 6:
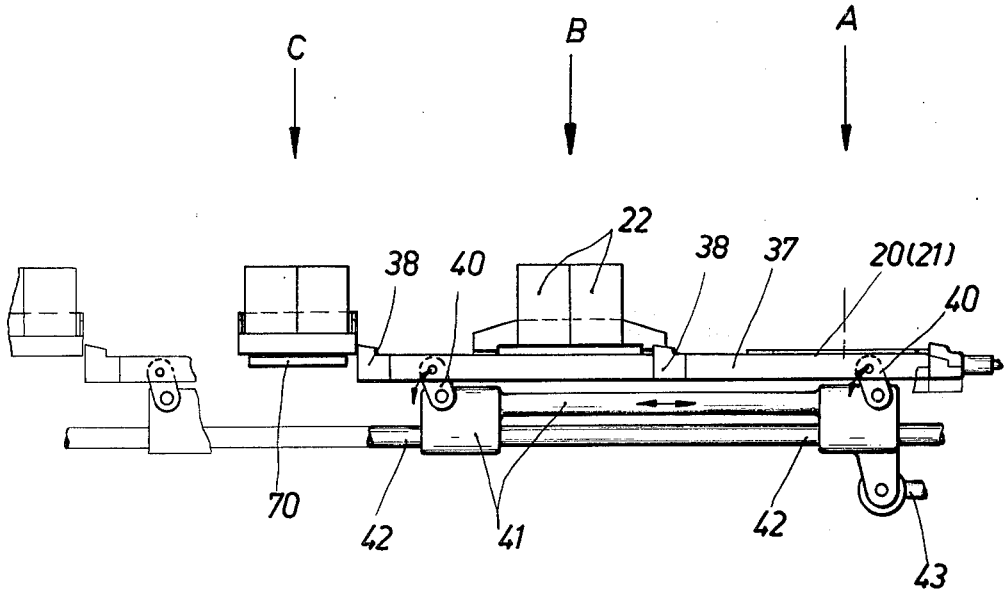
FIG. 6 shows a detail of the apparatus according to FIG. 5 in schematic side view.

For this purpose the transport frame 37 is mounted on an under-carriage 41 above parallelogram guide 40. This under-carriage 41, in turn, can be shifted, namely slid, on two parallel, stationary guide rods 42. The under-carriage 41 is driven back and forth, for example, by a cam drive, of which the end of a cam shaft 43 is shown in FIG. 6. The movements of the under-carriage 41 are transferred to the transport frame 37 by the parallelogram guide 40. The height position thereof is determined by the angular position of the parallelogram guide 40. In FIG. 6 the feed position is shown. In the opposite movement during the return from the final position (FIG. 6 left) into the original position, the transport frame 37 is first pivoted relative to the under-carriage 41, by means of which the transport frame 37 is lowered out of the delivery plane of the blanks. For this purpose the transport frame 37 can be moved by a special drive device, for example by a pressure medium cylinder (not shown), the piston rod 44 of which engages the transport frame 37.

In station B the initially flat blanks are fed in. For this purpose a feed device (FIG. 5) is provided at the side next to the transport frame 37. The feed device consists of a double slide 45, which can be moved back and forth across the delivery direction of the blanks, having two carrier pins 46, 47, each to contact a package contents, i.e. a group of individual packages 22. The feeding takes place in such a manner that during a first delivery cycle a group of individual packages 22 is conveyed by the forward carrier pin 46 until contact is made with the tray 20 and thereafter, namely in a second operational cycle, this first group is conveyed to the tray 21 and a succeeding group is conveyed onto the tray 20. The feeding of the blanks with two groups of individual packages 22 takes place, accordingly, in two work strokes of the double slide 45. The distances of the carrier pins 46, 47 from each other are chosen in such a manner that the exact final positions of the groups on the tray 20, 21 are established.

The double slide 45 is shiftably mounted on a lateral, in the present case, rectangular rod 48. The rod 48 itself is rotatably held in end mounts 49. During the return to the original position the double slide 45 is pivoted by rotating the rod 48, in the present case counter-clockwise (FIG. 8), and can therefore return to the original position without colliding with the groups of individual packages 22.

Further on, in station B a preliminary folding of the blank is performed. For this purpose a preliminary folding member 51 which is capable of being lifted or lowered is arranged beneath the transport plane for the blanks, namely beneath a mounting plate 50. This preliminary folding member 51 enters into the transport path of the blanks with three spacedly arranged folding bars 52, 53 from beneath in such a manner that the connected center panels 24, 25 are lifted to form a flat, inverted V by the folding bar 53. This folding procedure automatically results in a certain pushing together of the trays 20, 21 with the groups of individual packages 22. At the same time the outer panels 28 are also folded into a slight angular position by the outward lying folding bar 52. To secure the package contents during this folding process a counter support 54 is arranged on the upper side of the individual packages 22.

With a preliminary fold as described above, the double packages are conveyed together with package contents to station C. Here the folding is completed and the package accordingly finished.

Identical and synchronously moved end folding members 55 are mounted at the sides of the conveyor belt. These end folding members 55 are brought toward the preliminary folding package in the area of the outer panels 28 by sliding along support rods 56. The end folding members 55 are provided with a folding plate 57, which is taken toward the respective outer panels 28 by the described movement and pivot same into an upright position where they abut the package contents. The folding plate 57 is slidably mounted on a plate holder 60 by means of bolts 58 against the load of compression springs 59. As described, as they meet the outer panels said panels are brought into their upright position. Any further forward motion of the plate holder 60 takes place only under compression of the springs 59. The folding plate 57 thereby remains in the final position shown, namely in abutment with the outer panel 28. By means of the resulting relative movement further folding members, namely corner folders 61 are pivotally activated. This pivoting motion folds the initially laterally upright corner flaps 29, 30 by 90° until they abut the previously folded side panels 26, 27. The corner folders 61 are pivotably mounted for this purpose on the back side of the folding plate 57 and have an angular shape. A pressure roll 62 arranged on the corner folder 61 is acted upon by the plate holder 60 during the described relative motion in such a manner that the corner folder 61 performs a pivoting motion against the load of a draw spring 63. The pivoting motion corresponds to the folding motion for the corner flaps 29, 30.

In a synchronously controlled folding process, first the side panels 26, 27 are folded by overlapping movements into an upright position abutting the package contents. This folding process is overlapped with the folding of the corner flaps 31, 32 lying in the center of the package.

Figure 9:
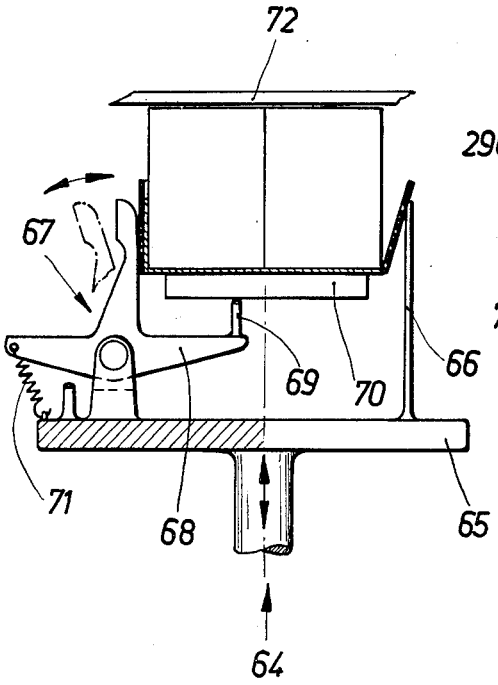
FIG. 9 shows a further detail of the apparatus in the area of a station for the manufacture of the package in side view, i.e. in section.
Figure 10:
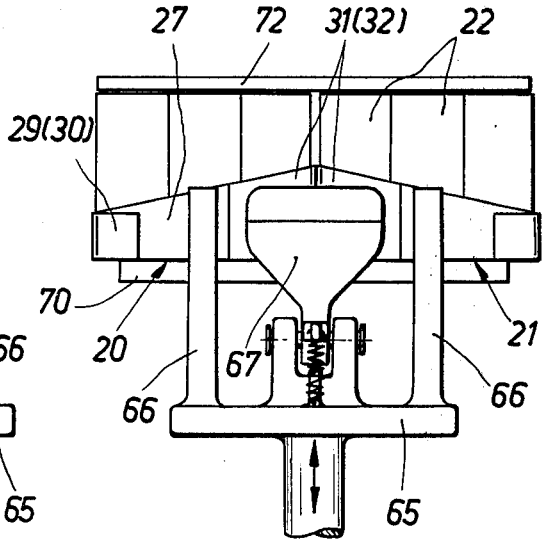
FIG. 10 shows a detail according to FIG. 9 in a side view displaced by 90°.
Figure 11:
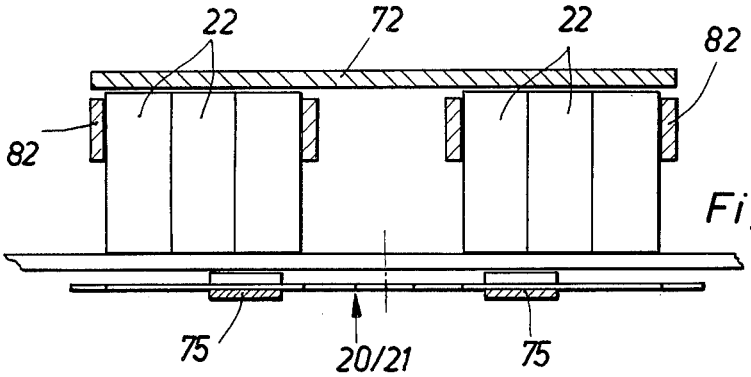
FIGS. 11–14 show individual phases in the production of a package in the continuous process, in cross section.
Figure 12:
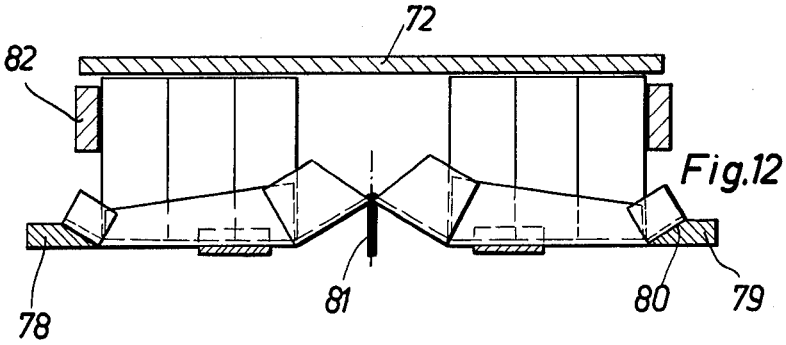
Figure 13:
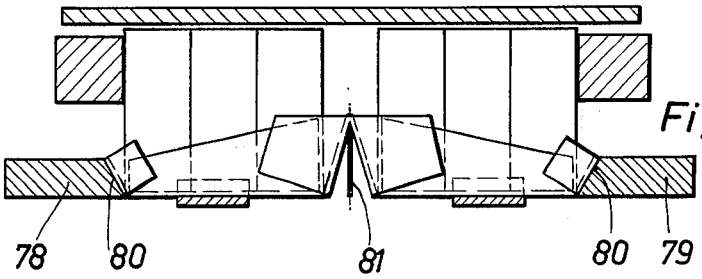
Figure 14:
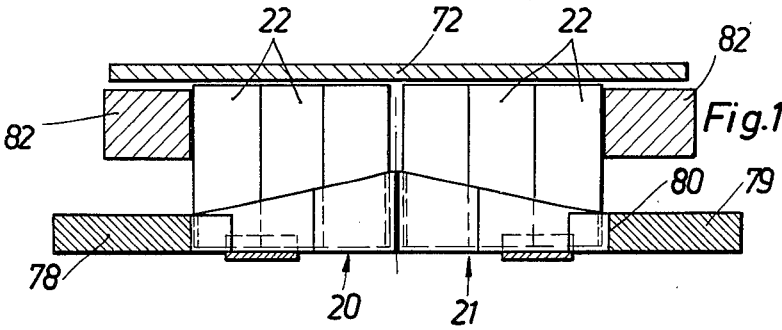

According to FIGS. 9 and 10 a side folding member 64 common to both sides of the package is brought toward the package from beneath. Bar-like erecting members 66 respectively associated with the two trays 20, 21 are arranged on a support plate 65 at a certain distance from the package contents. By means of these basically immovable, rigid erecting members 66 the side panels 26, 27 are brought into a nearly vertical position (FIG. 9 right side). The completion of the folding movement is then taken care of by a central folder 67, which is here pivotally mounted on the support plate 65 as an angle element. A projecting shank has a stop 69 which meets the underside of the package or a package floor 70. In this manner the central folder 67 is pivoted clockwise against the load of a draw spring 71, while moving both the side panels 26, 27 and the pre-folded corner flaps 31, 32 to abutment with the package contents. The individual packages 22 are also held in place by a counter support 72 in the vicinity of station C.

The finished package can then be conveyed away and for example be provided with an outer wrapper.

The formation of the packages in the exemplary embodiment in FIGS. 11 through 16 takes place together with filling with a continuous transport of the individual elements.

The groups of individual packages 22 in the exemplary embodiment shown are separated on a feed plate 73 and transported with lateral spacing from each other by an endless conveyor, specifically a chain conveyor 74. The blanks for the formation of the double packages are transported from beneath by a blank conveyor 75 up to the plane of the feed plate 73. The course of the movement is synchronously controlled in such a manner that the groups of individual packages 22 are placed exactly on the floor walls 23 of the trays 20, 21.

In the further course of transport double folders 77 moved by an endless conveyor 76 accompany the above elements. These double folders 77, which are independently movable relative to the endless conveyor 76, perform together with further folding members, the erection and folding of the side panels 26 and 27 lying on the front and back sides.

The further folds are performed in the present case by stationary folding members in such a manner that the folding movements take place automatically by means of the relative motion of the blanks with the package contents with regard to the stationary folding members.

For this purpose folding guides 78, 79 are mounted at both sides of the transport path. These folding guides have angled folding surfaces 80 on the side facing the packages. The shape of these folding surfaces 80 is chosen so that the outer panels 28 projecting laterally beyond the package contents, together with the corner flaps 29, 30 connect thereto, are contacted by the changing inclination of the folding surfaces 80 and erected during the transport. The relative position of the folding guides 78, 79, namely their spacing from each other, is arranged in such a manner that during this folding process both halves of the package, namely the trays 20, 21, are simultaneously pushed together.

The folding up of the center panels 24, 25 also takes place by means of a stationary folding member, specifically a central folding bar 81. This central folding bar 81 extends in the area of the folding edge 33, its elevation increasing in the direction of transport. The simultaneous pushing together of the trays 20, 21 and the action of this folding bar 81 effects the upward folding of the center panels 24, 25.

The process of pushing the package halves together is also supported by lateral guide members, specifically side pressure guides 82, which have a continuously decreasing distance from each other caused by increasing cross-sectional width in the direction of transport. The individual packages 22 directly abutting these pressure guides 82 are thereby moved toward each other with the package halves. This folding and lateral shifting process is coordinated with the movable double folders 77, so that the corner flaps 29 . . . 32 are simultaneously folded into their final positions.

Figure 19:
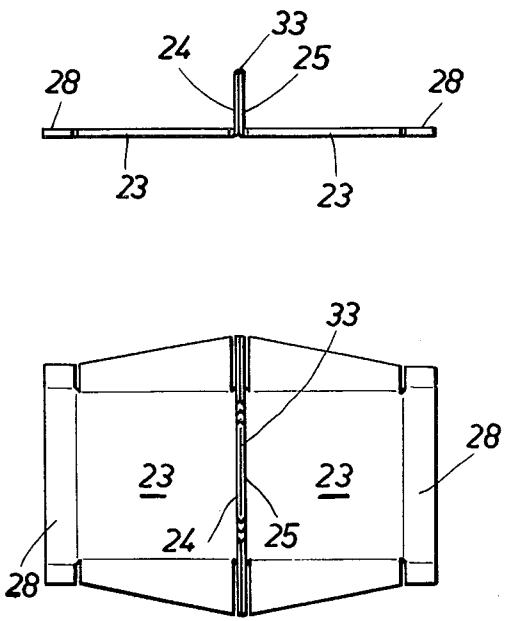
Figure 18:
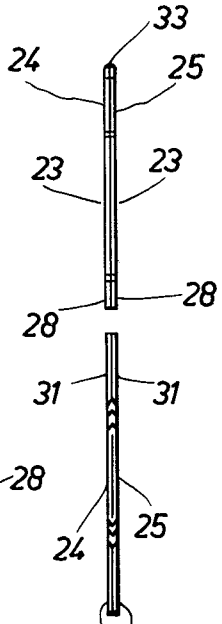
Figure 17:
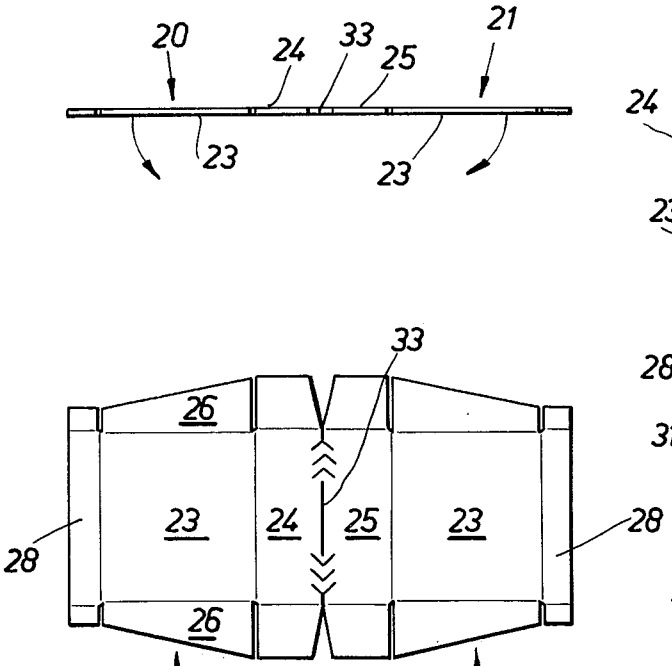

A further exemplary embodiment of the invention is described below in greater detail with the aid of FIGS. 17–19, in which:

FIG. 17 shows a spread blank in the sense of the invention in side view and plan view as a first phase of the process, FIG. 18 shows an intermediate folded position, also in side view and plan view, and FIG. 19 shows an illustration according to FIG. 18 after the trays have been folded back into their original position.

As an alternative to the above-described possibilities for the manufacture of double packages, one may proceed according to FIGS. 17 through 19. The initially spread, one-piece blank (FIG. 17) is folded in the area of the folding edge 33 between the center panels 24, 25 by respective clockwise and counterclockwise pivoting of the blank halves. The pivoting movement continues until the blank halves abut one another (FIG. 18). At this point the center panels 24, 25 also abut each other. Subsequently, the floor walls 23 of the trays 20, 21 with the connected blank elements (side panels and outer panels) are folded back in the opposite direction until they reach the horizontal position (FIG. 19). The further folding steps, i.e., those of the side panels 26, 27 and the outer panels 28 and the corner flaps 29, 30, 31, and 32 can then proceed.

The above folding process can take place very efficiently in a continuous mode of operation, i.e. during continuous transport of the blanks. By means of suitable, known, stationary folding guides, the blank halves are folded downwardly in the sense described. In the intermediate position according to FIG. 18 the center panels 24, 25 are held in abutment with each other by means of either accompanying or stationary holding members, while the floor walls 23 are folded back into the horizontal positions during transport by means of, for example, stationary folding guides which diverge in the direction of transport.

I claim:

1. A process for the production and filling of an outer package having two partial packages (20, 21) with two inner packages, said two partial packages being disposed side by side and formed from one uniform blank, the packages being interconnected by a central wall erected by pushing the partial packages toward each other to produce double tray packages open on top with central panels (24, 25) forming the central wall, lateral panels (26,27) and outside panels (28) forming outer walls, the process comprising:

(a) horizontally conveying the blank, spread out flat, in cyclically changing periods of motion and stoppage, the central panels (24,25) being unfolded and extending in the direction of conveyance, (b) in a first station engaging two spaced inner packages located on one side of the conveying path with separate pushing elements and pushing said inner packages in a single path and in a single direction transverse to the direction of conveyance of the blank, during a first phase of stoppage of the unfolded blank, so as to position the two inner packages spaced from each other by the width of the central panels (24,25) on respective areas of the blank corresponding to the two partial packages;

(c) thereafter, while still in the first station, folding the central panels (24,25) between said spaced inner packages and the outside panels (28) into an intermediate folded position, (d) pushing, in a second station, the two partial packages together, without changing the positions of the two inner packages relative to the two partial packages during a second phase of stoppage of the blank subsequent to and not continuous with the first phase of stoppage, thereby folding the central panels into an upright position (24,25) until the central wall abuts the two inner packages, and erecting the outer panels (28) into an upright position, and (e) then erecting the lateral panels (26,27) into an upright position.

2. The method according to claim 1 further comprising: folding the central panels and the lateral panels (26,27) into an intermediate folded position in the first station; and folding to completion the lateral panels (26,27) at the second station.

3. The method according to claim 1 or 2 further comprising: folding the lateral panels (26,17) right up to the package contents; and folding corner flaps (29,30,31,32) connected to the central panels (24,25) and the outside panels (28) to the outside of the folded lateral panels (26,27).

* * * * *